US007347125B1

(12) United States Patent
Juieng

(10) Patent No.: US 7,347,125 B1
(45) Date of Patent: Mar. 25, 2008

(54) AUTOMATIC ADJUSTABLE HEAD WRENCH

(76) Inventor: Daniel Juieng, 743-2 Houston Mill Rd., Atlanta, GA (US) 30329

( * ) Notice: Subject to any disclaimer, the term of this patent is extended or adjusted under 35 U.S.C. 154(b) by 0 days.

(21) Appl. No.: 11/531,335

(22) Filed: Sep. 13, 2006

(51) Int. Cl.
*B25B 13/22* (2006.01)
*B25B 7/04* (2006.01)

(52) U.S. Cl. ..... 81/129.5; 81/418

(58) Field of Classification Search ..... 81/126, 81/129.5, 186, 418
See application file for complete search history.

(56) References Cited

U.S. PATENT DOCUMENTS

| | | | | | |
|---|---|---|---|---|---|
| 56,731 | A | * | 7/1866 | Dodge | 81/174 |
| 623,337 | A | * | 4/1899 | Rydberg | 81/356 |
| 753,456 | A | * | 3/1904 | Weidinger | 7/133 |
| 785,586 | A | * | 3/1905 | Wulst | 81/356 |
| 1,085,198 | A | * | 1/1914 | Finney | 81/356 |
| 1,162,136 | A | * | 11/1915 | Chapman | 81/356 |
| 1,181,654 | A | | 5/1916 | Eifel | |
| 1,207,064 | A | * | 12/1916 | Metcalf | 81/356 |
| 1,244,966 | A | * | 10/1917 | Eifel | 81/356 |
| 1,367,711 | A | * | 2/1921 | Nortwed | 81/356 |
| 1,503,662 | A | | 8/1924 | Norton | |
| 1,540,464 | A | * | 6/1925 | Edwards | 81/356 |
| 1,546,139 | A | * | 7/1925 | Leveque | 81/365 |
| 1,680,956 | A | * | 8/1928 | Simonsen | 81/356 |
| 1,862,817 | A | * | 6/1932 | Eifel | 81/356 |
| 2,084,633 | A | * | 6/1937 | Erickson | 81/365 |
| 2,156,529 | A | | 5/1939 | Day | |
| 2,330,303 | A | | 5/1943 | Ross | |
| 2,382,606 | A | * | 8/1945 | Clark | 81/356 |
| 2,397,095 | A | * | 3/1946 | Emmett | 81/356 |
| 2,481,866 | A | | 9/1949 | Petersen | |
| 2,524,689 | A | | 10/1950 | Westman | |
| 2,905,038 | A | | 9/1959 | Paden | |
| 3,241,410 | A | | 3/1966 | Paden | |
| 3,290,970 | A | * | 12/1966 | De Lucia | 81/127 |
| 3,608,405 | A | | 9/1971 | Schmidt | |
| 3,635,107 | A | * | 1/1972 | Schmidt | 81/367 |
| 4,147,077 | A | | 4/1979 | Tasato | |
| 4,269,089 | A | | 5/1981 | Hastings | |
| 4,375,174 | A | | 3/1983 | Shanley, Jr. | |
| 4,438,669 | A | | 3/1984 | Hastings et al. | |
| 4,440,047 | A | * | 4/1984 | Robbins | 81/179 |
| 4,651,598 | A | | 3/1987 | Warheit | |
| 4,662,252 | A | | 5/1987 | Warheit | |
| 4,802,390 | A | | 2/1989 | Warheit | |
| 4,893,530 | A | | 1/1990 | Warheit | |
| 5,060,543 | A | | 10/1991 | Warheit | |
| 5,176,049 | A | * | 1/1993 | Neff | 81/360 |
| 5,351,584 | A | | 10/1994 | Warheit | |
| 5,385,072 | A | | 1/1995 | Neff | |
| 6,014,917 | A | | 1/2000 | Bally et al. | |

(Continued)

*Primary Examiner*—David B Thomas
(74) *Attorney, Agent, or Firm*—Gardner Groff Greenwald & Villanueva, P.C.

(57) ABSTRACT

An adjustable wrench including a head having parallel jaws. The parallel jaws include a first fixed jaw and a movable second jaw. The second jaw is mounted to the head for parallel, sliding movement relative to the first jaw. The wrench also includes a first handle rigidly coupled to the first jaw, and a second handle pivotally mounted to the first handle and coupled to the second jaw. The second handle is coupled to the second jaw such that movement of the handles relative to each other causes the parallel jaws to open and close.

21 Claims, 8 Drawing Sheets

U.S. PATENT DOCUMENTS

| | | | | |
|---|---|---|---|---|
| 6,065,376 | A | 5/2000 | Khachatoorian | |
| 6,279,431 | B1 | 8/2001 | Seber et al. | |
| 6,502,482 | B1 | 1/2003 | Putsch et al. | |
| 6,626,070 | B2 | 9/2003 | Peperkorn et al. | |
| 7,191,688 | B1 * | 3/2007 | Hall, Jr. | 81/411 |
| 2006/0236823 | A1 * | 10/2006 | MacLain | 81/418 |

* cited by examiner

AUTOMATIC ADJUSTABLE HEAD WRENCH

TECHNICAL FIELD

The present invention relates generally to the field of tools, and more particularly, to a wrench having an automatic adjustable head.

BACKGROUND OF THE INVENTION

Adjustable head wrenches are well known in the art and typically have one adjustable jaw and one stationary jaw for engaging objects of different dimensions within the adjustment range of the wrench. In many wrenches having an adjustable head, a worm gear member is fixed to the body of the wrench and is geared to corresponding teeth in the jaw to be moved. In many instances, the worm gear is rotated with the user's thumb. As the worm gear is rotated, the movable jaw's teeth are engaged by the gear and carry the movable jaw over the worm gear to adjust the distance between the stationary jaw and the movable jaw.

When in use, a user must manipulate the worm gear each time the user wishes to engage a different sized object, such as a nut or bolt, to adjust the size of the wrench head accordingly. When sequentially engaging nuts or bolts of varying dimensions, it may be commonly required for a user to adjust the wrench head size for each individual nut or bolt. Having to repeatedly adjust the distance between the two jaws of the wrench can be inconvenient to a user, especially when the user is working with multiple nut and bolt sizes. Additionally, when using an adjustable head wrench, a user is often required to remove the wrench head from the nut or bolt, reposition the wrench head, and reengage the wrench head with the nut or bolt when making a series of partial turns to tighten or loosen the same. Repeatedly having to engage is such steps can be inconvenient to a user.

Pliers-type wrenches are also well known in the art and typically include two handles attached to a set of jaws, wherein each handle is coupled to a separate jaw, and a pivot point in proximity with the jaws. Typically, the leverage provided by the handles of such wrenches increases as the proximity of the pivot point to the jaws increases, and as such, so does the mechanical advantage that is provided to a user. However, because the handles and jaws act as levers, the ends of the handles are generally spread apart farther than the opening between the jaws. For example, if the handles are four times longer than the jaws (generally a mechanical advantage of four), then the handles will need to be spread apart four times farther than the desired opening between the jaws. Because the space in which a user may operate pliers-type wrenches is often limited due to spatial constraints such as hand size or available work space, traditional pliers-type wrenches may only be able to provide a user with a very limited amount of leverage in such instances.

Accordingly, it can be seen that needs exists in the art for an automatic adjustable head wrench that permits a user to forego repeatedly adjusting the wrench head size and does not require a user to reposition the wrench head on a nut or bolt when making consecutive turns to tighten or loosen the same. Additionally, needs exist for an adjustable head wrench that foregoes the leverage problems associated with pliers-type wrenches. Therefore, it is to the provision of these needs and others that the present invention is primarily directed.

SUMMARY OF THE INVENTION

Briefly described, in one preferred form the present invention comprises an automatic adjustable head wrench for adapting to objects having varying dimensions. In one aspect, the present invention is an adjustable wrench having an adjustable head with a fixed jaw and a movable jaw. The movable jaw is mounted for sliding movement in relation to the fixed jaw, with the fixed jaw and movable jaw having substantially parallel jaw faces. The wrench also includes a pliers-style handle mechanism with first and second handles coupled to the fixed jaw and the movable jaw. The handle mechanism is operated to draw the jaws tightly together when the first and second handles are squeezed together.

Optionally, the second handle is coupled to the movable jaw with a gear mechanism. Further still, the present invention may include a biasing mechanism, such as a spring, for urging the jaws toward a closed position. Additionally, the jaws may have tapered distal ends to allow the jaws to be eased over a nut.

In another aspect, the invention is a hand tool comprising a head having parallel jaws. The parallel jaws include a fixed first jaw and a movable second jaw, wherein the second jaw is mounted for parallel, sliding movement relative to the first jaw. The invention also includes a first handle rigidly coupled to the first jaw and a second handle pivotally mounted to the first handle. The second handle is also coupled to the second jaw such that movement of the handles relative to each other causes the parallel jaws to open and close.

One advantage of the present invention is that a user is able to engage nuts and bolts having varying dimensions without manually adjusting the distance between the wrench's jaws for each nut or bolt. Another advantage of the present invention is that a user is able to draw the jaws tightly against a nut or bolt being engaged. A still further advantage of the present invention is that the user can apply leverage after the jaws have already been positioned around an object.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

Figure 1:
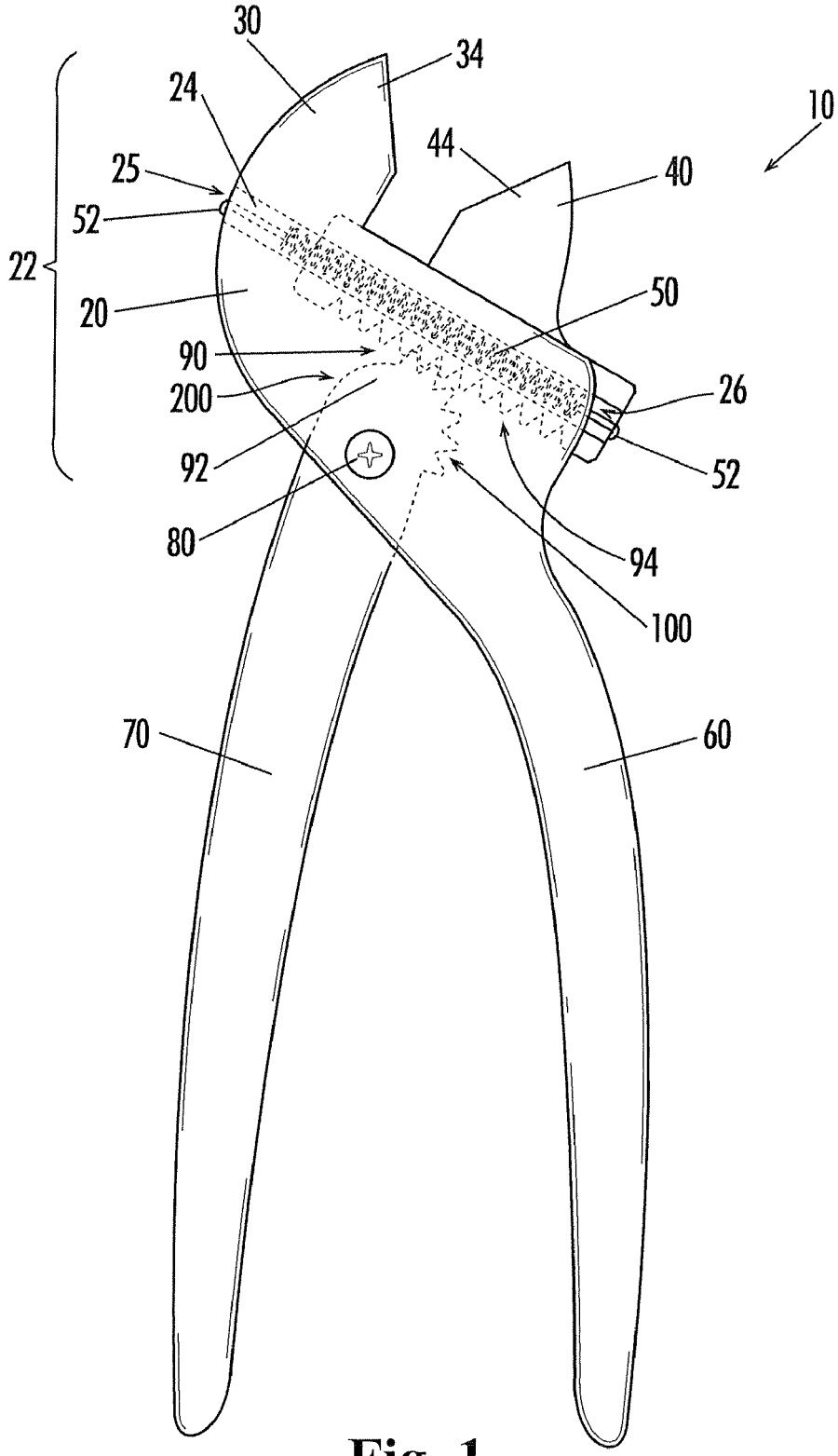
FIG. 1 is a front view of an automatic adjustable head wrench according to an example embodiment of the present invention.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, FIGS. 1-8 show an automatic adjustable head wrench 10 according to example embodiments of the present invention. The wrench 10 generally comprises a body 20, fixed jaw 30, movable jaw 40, biasing member 50, fixed handle 60, and movable handle 70. The wrench 10 may vary in size depending on the intended use and needs of a user, although generally the wrench is intended to be handheld. However, it is conceivable that the size of the wrench 10 may be much larger or smaller as necessary. The wrench 10 of the present invention allows a user to engage objects having varying dimensions, such as different sized nuts or bolts, without having to manually adjust the head size of the wrench.

In example embodiments, the automatic adjustable head wrench 10 has a rigid fixed body 20 comprised of steel, iron, or any other suitably rigid material(s). The body 20 includes a head portion 22 and a fixed handle 60 formed at opposing ends of the body. A fixed jaw 30 extends at one end of the head portion 22. A second, parallel movable jaw 40 is slidably mounted to the head portion 22 of the body 20, whereby the two jaws are adapted to receive an object between them. The jaws 30 & 40 have tapered ramps/cams 34, 44 respectively, for allowing the jaws to easily receive and slide over a nut or bolt. Additionally, the jaws preferably have flat faces for engaging nuts and bolts; however, in alternative embodiments, the jaws can be cutter style jaws (see FIG. 8A) for cutting wire, tree limbs, rope, etc. Other possible types of jaws include concave or convex jaws, inwardly sloping jaws, 120-degree recess jaws (see FIG. 8E), grooved jaws, a combination of one or more of the aforementioned jaw types (see FIGS. 8A-8H), or the jaws can be interchangeable. The head portion 22 of the body 20 further includes a biasing member 50 for urging the two jaws towards a closed position. As seen in the drawing figures, the biasing member 50 is an extended coiled spring, however, in alternative embodiments other biasing mechanisms may be used, such as leaf springs, torsion springs, compressed springs, or any other suitable biasing mechanism.

A cavity or recess 24 is present in example embodiments for enclosing the coiled spring biasing member 50 within the head portion 22 and has openings 25, 26 at distal ends of the cavity. However, one or both openings can be omitted or the cavity 24 can be omitted altogether in embodiments using alternative biasing mechanisms. As depicted in the drawing figures, there are a multitude of options for connecting the biasing member 50 to the jaws 30, 40. Hooks 52 extending from the distal ends of the coiled spring 50 can be used to secure the spring to the body 20 and the movable jaw 40 as seen in FIG. 1. In alternative embodiments, the biasing member 50 can be secured with a combination of hooks 52, pins 53 (see FIG. 5) and/or screws 54 (see FIG. 7).

The handle configuration of the present invention can be described as a "pliers" style configuration in which a user engages both handles to operate the wrench 10. As such, the movable handle 70 is rotatably mounted to the body 20 with a coupling mechanism 80, such as a shouldered axle screw or a nut and bolt, which permits the handle to pivot about the mechanism 80. The movable handle 70 is geared to the movable jaw 40 with a rack and pinion gear 90. As best seen in FIG. 1, the movable handle 70 has geared teeth 100 in the form of a pinion gear 92, extending from a distal end of the handle for engaging a complementary row of geared teeth in a rack gear 94, along a bottom portion of the movable jaw 40. Portion 200 of the pinion gear 92 does not have teeth, but rather is preferably smooth. Axial rotation of the movable handle 70 away from the fixed handle 60 and body 20 causes the geared teeth 100 of the pinion gear 92 to cease to engage the complementary rack gear 94. Once the geared teeth 100 no longer engage the rack gear 94, the spring-like mechanism 50 forces the jaws 30,40 together. Conversely, axial rotation of the movable handle 70 towards the fixed handle 60 and body 20 causes the teeth portion 100 of the pinion gear 92 to engage the complementary rack gear 94 and move the corresponding movable jaw 40 longitudinally towards the fixed jaw 30. It is preferred that the movable handle 70 and rack and pinion gear 90 be manufactured from steel, iron, or any other suitably rigid material.

Figure 2:
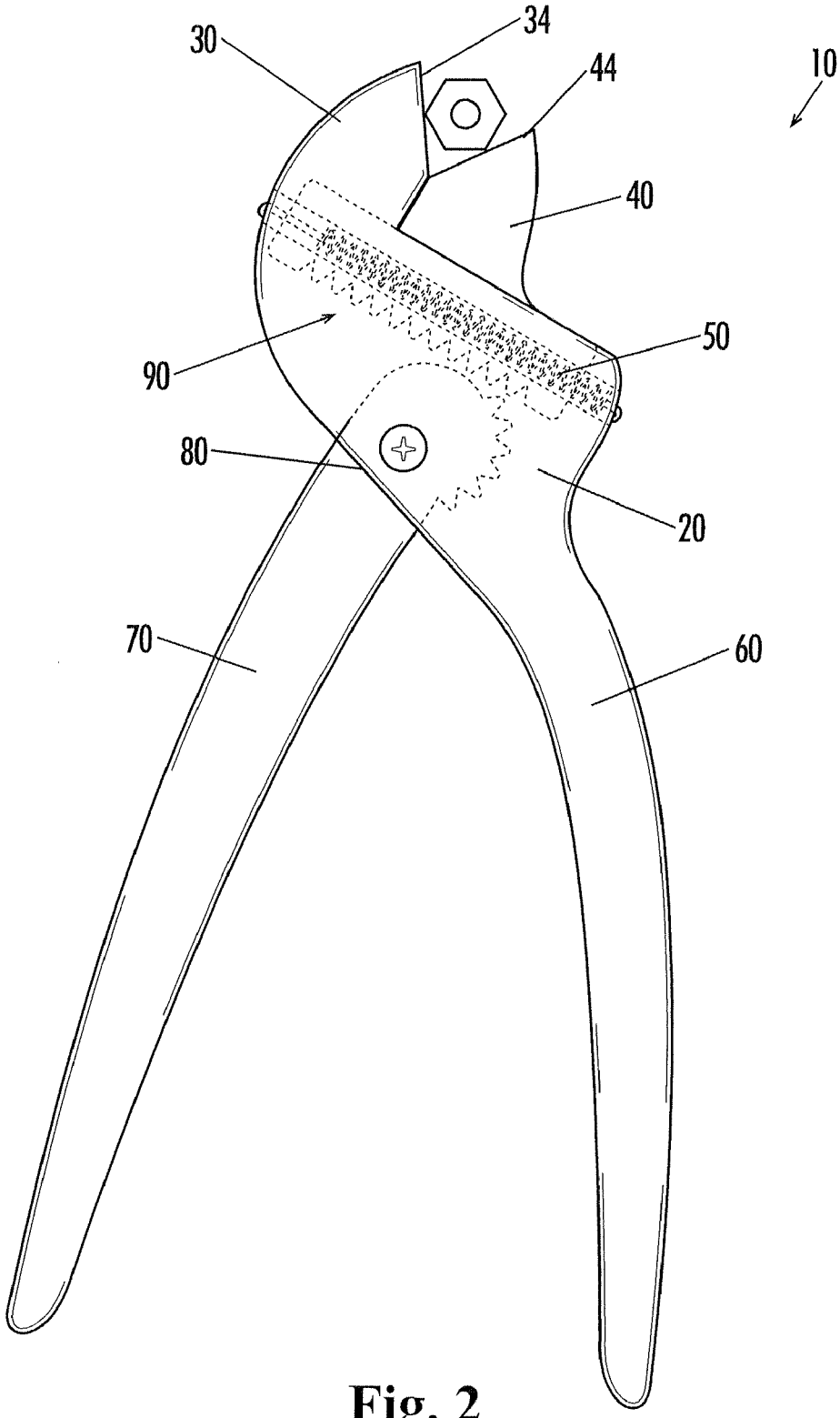
FIG. 2 is a front view of the automatic adjustable head wrench of FIG. 1 showing the jaws in a substantially closed position.
Figure 3:
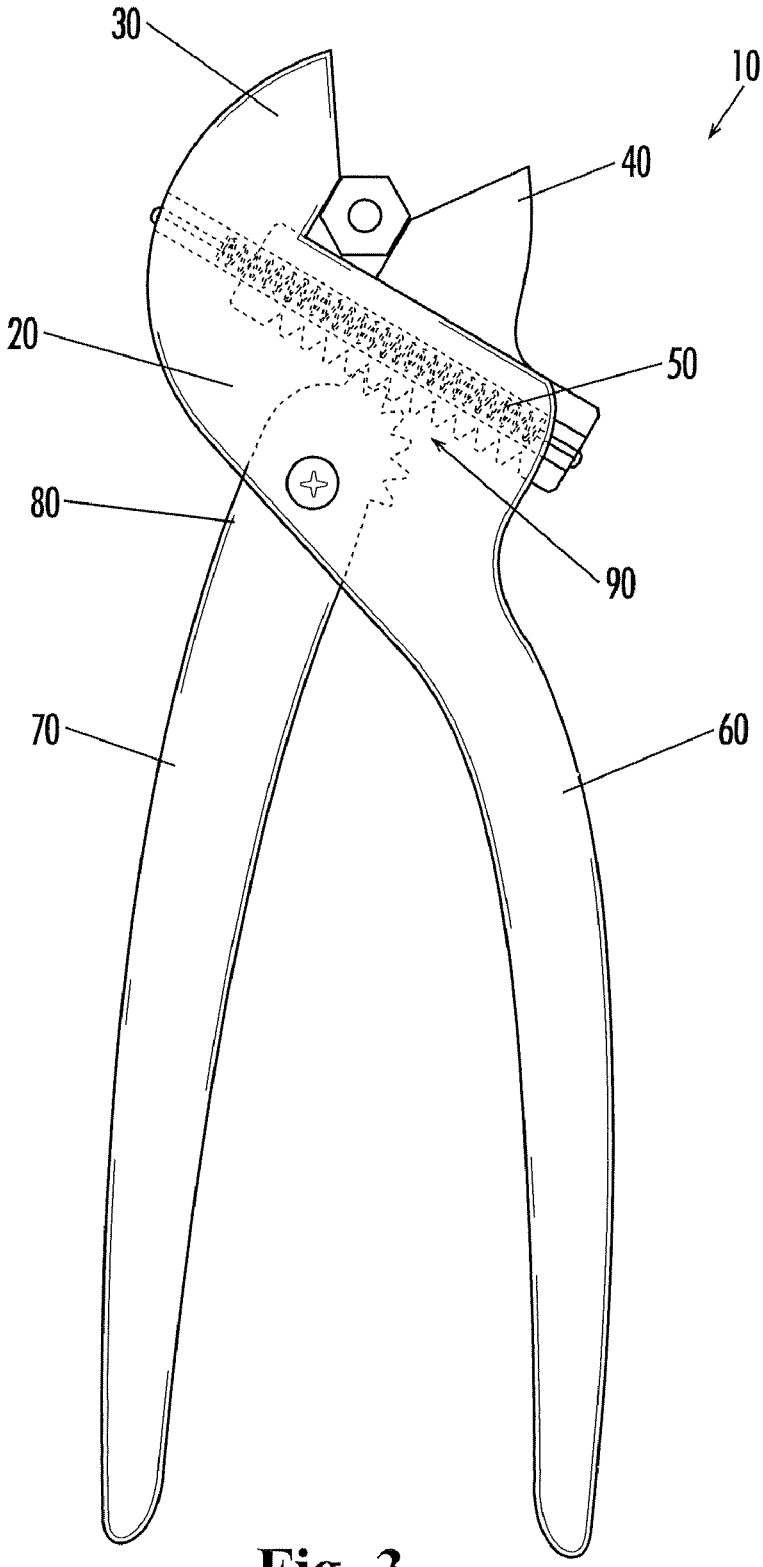
FIG. 3 is a front view of the automatic adjustable head wrench of FIG. 1 showing the wrench engaging a nut.
Figure 4:
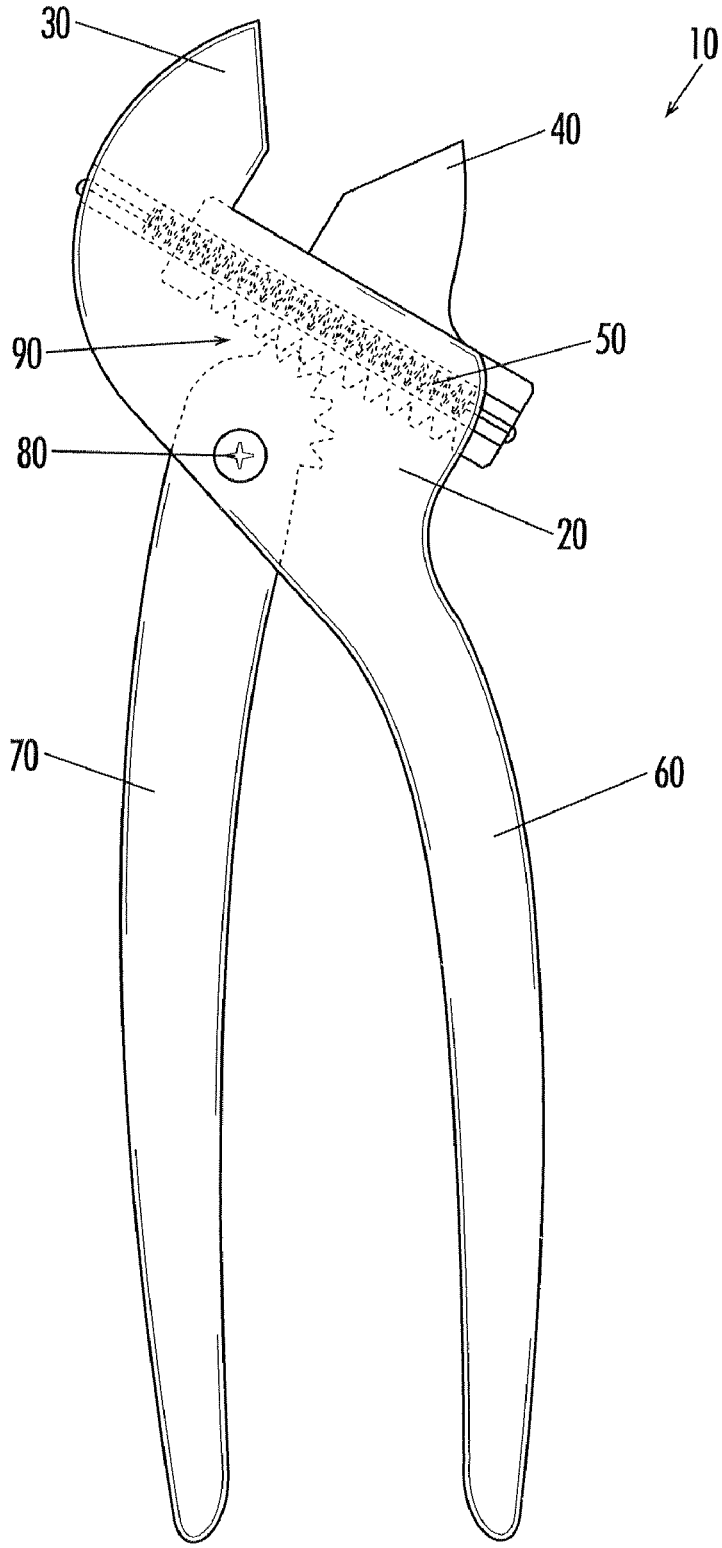
FIG. 4 is a front view of an automatic adjustable head wrench according to another example embodiment of the present invention.
Figure 5:
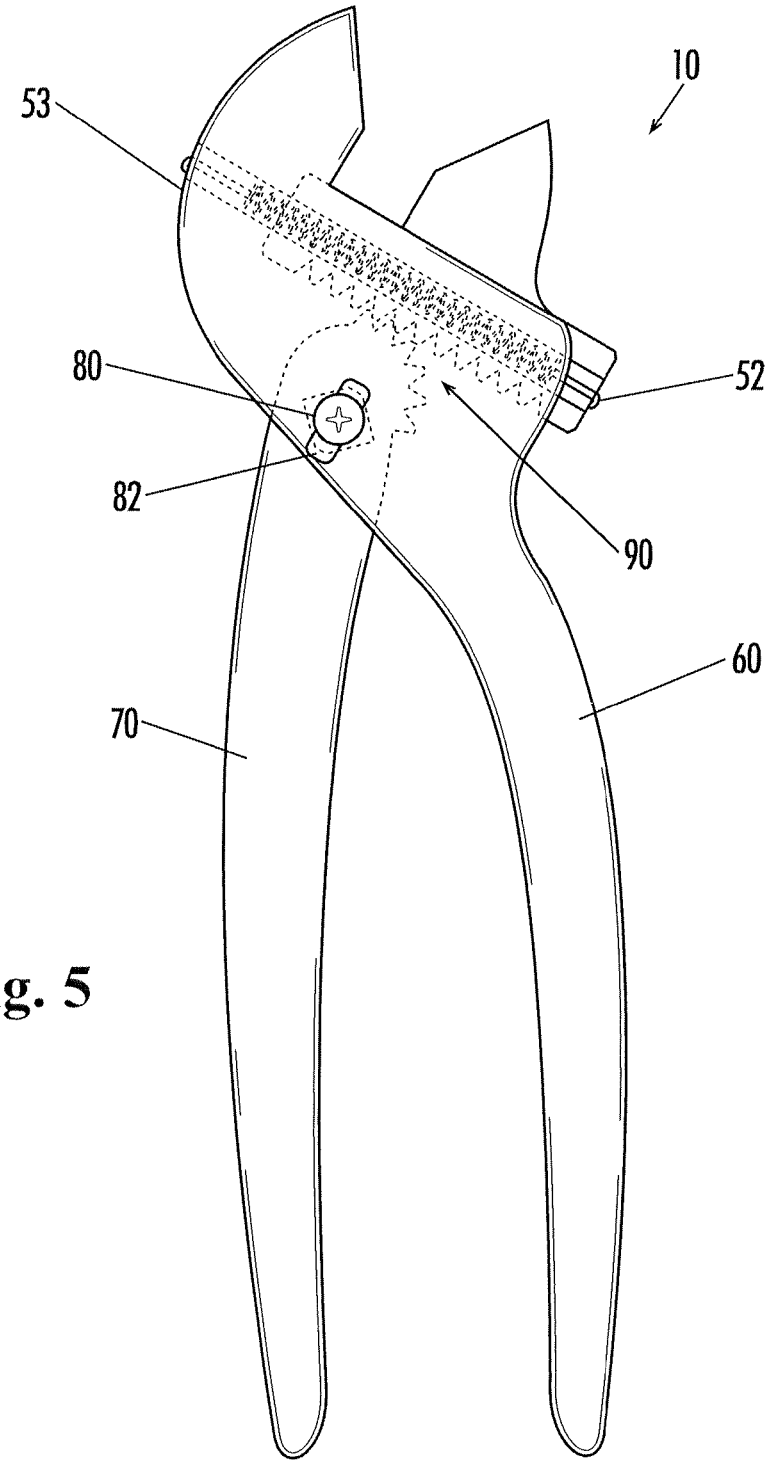
FIG. 5 is a front view of an automatic adjustable head wrench according to another example embodiment of the present invention.
Figure 6:
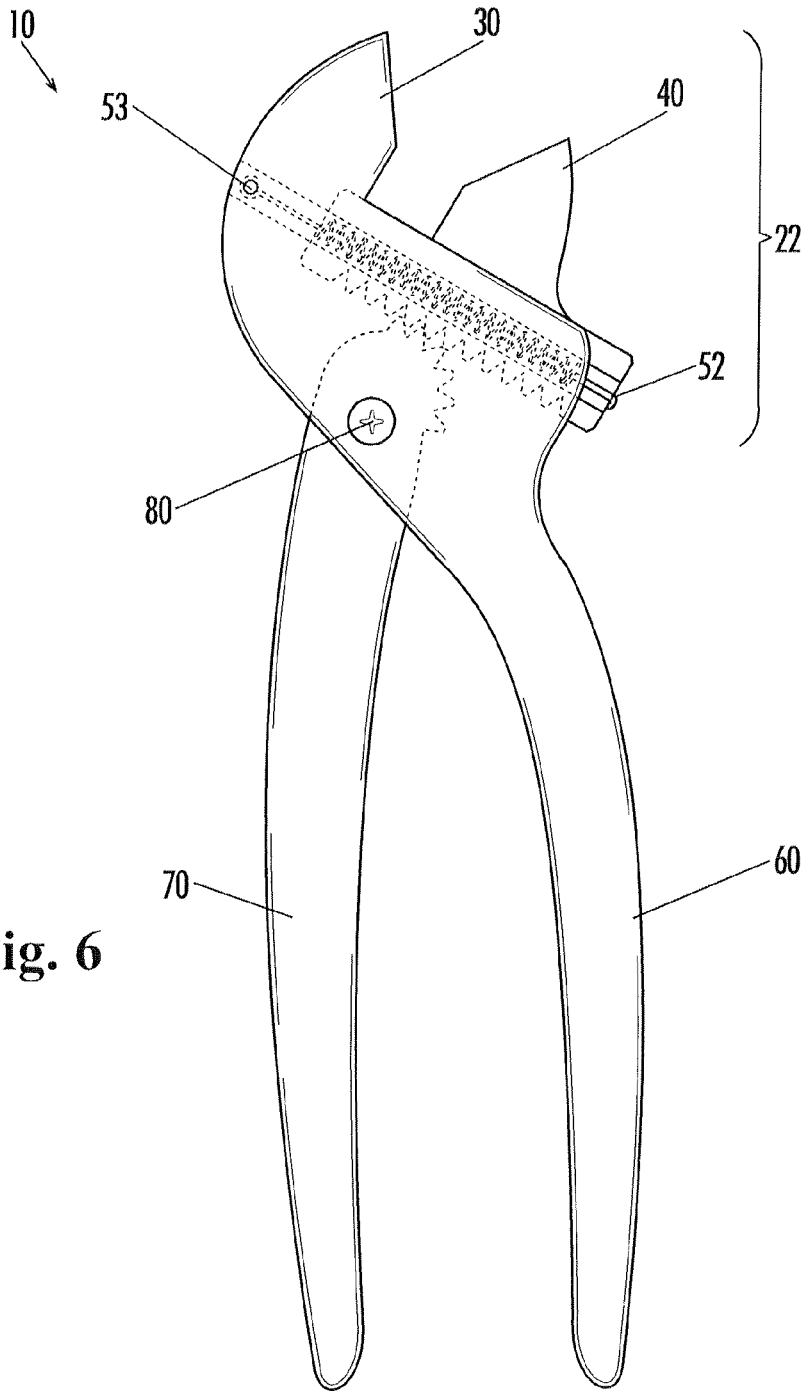
FIG. 6 is a front view of an automatic adjustable head wrench according to another example embodiment of the present invention.

In operation, a user engaging a nut, bolt, or other object can slide the ramps/cams 34 & 44 of the jaws over the nut or bolt as seen in FIG. 2. Because the biasing member 50 urges the jaws towards a closed position, the ramps 34 & 44 serve to allow the jaws to receive a nut or bolt therein by prying the movable jaw 40 away from the fixed jaw 30 to accommodate the nut or bolt as seen in FIG. 3. In order to begin tightening or loosening the nut or bolt, a user would then hold the jaws tight against the nut or bolt. This can be accomplished by squeezing the movable handle 70 towards the fixed jaw 60, which engages the rack and pinion gear, forcing the movable jaw 40 towards the fixed jaw 30. The closer the coupling mechanism 80 is located in relation to the rack and pinion gear 90, the higher the mechanical advantage becomes, such that less leverage force is required by the user to tighten and secure the jaws against the nut or bolt. FIG. 1 depicts an example embodiment having a lower mechanical advantage than the example embodiment shown in FIG. 4. Additionally, FIG. 5 depicts an additional example embodiment showing a wrench 10 of the present invention that allows a user to change the pivot point of the movable handle 70 to adjust the amount of leverage force applied to the nut or bolt as needed. In such an embodiment, the coupling mechanism 80 has a channeled slot 82 for positioning the mechanism closer or farther away from the rack and pinion gear 90. In another example embodiment, as seen in FIG. 6, the head portion 22 of the wrench 10 can be angled in the opposite direction as depicted in FIGS. 1-5 to allow for more comfortable use of the wrench depending on the preferences of the user.

Figure 7:
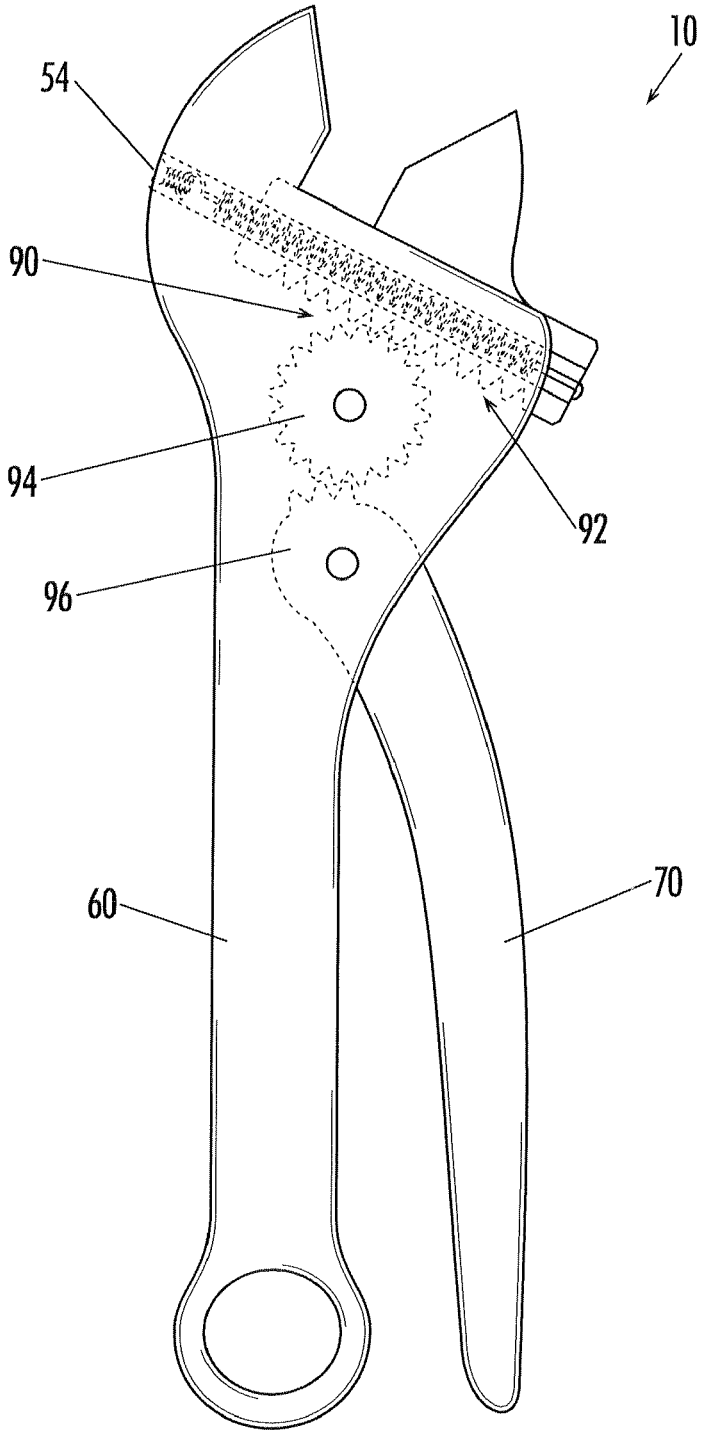
FIG. 7 is a front view of an automatic adjustable head wrench according to still another example embodiment of the present invention.
Figure 8A:
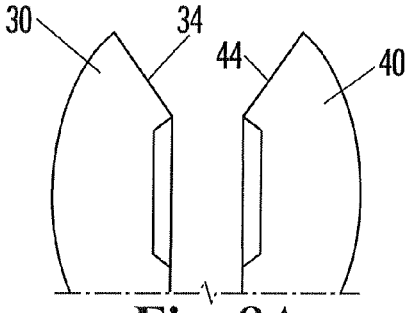
FIGS. 8A-8H are front views of a variety of example wrench head designs in accordance with the present invention.
Figure 8B:
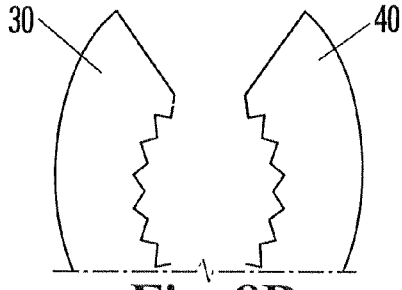
Figure 8C:
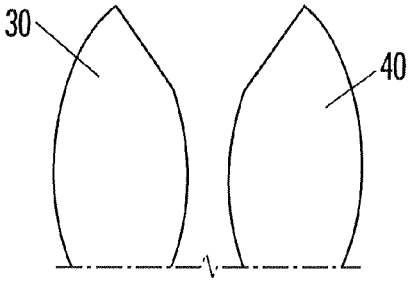
Figure 8D:
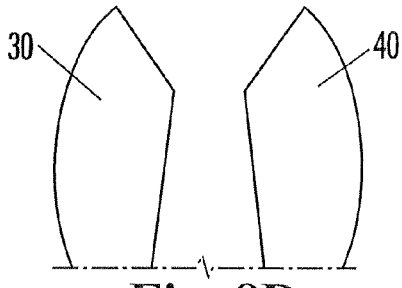
Figure 8E:
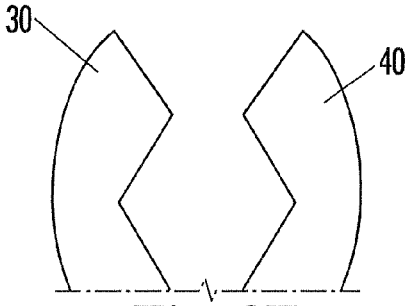
Figure 8F:
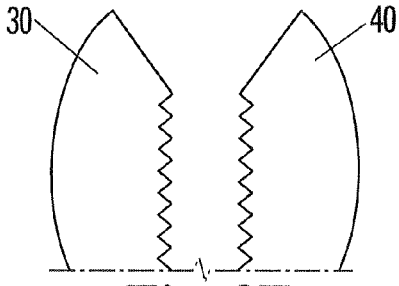
Figure 8G:
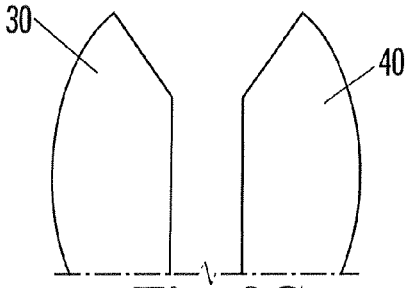
Figure 8H:
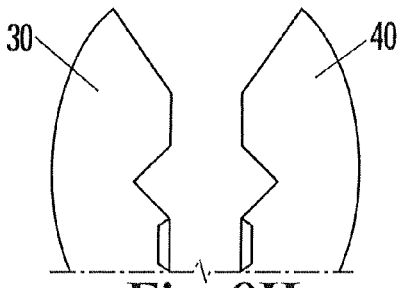

In still another alternative embodiment, the wrench 10 of the present invention can comprise a comfortable and more traditional "adjustable wrench" style handle configuration having a more substantial, centrally fixed handle 60 as seen in FIG. 7. In contrast to earlier described embodiments, a user may concentrate a greater percentage of the rotational force needed to tighten or loosen a nut or bolt on the fixed handle in the embodiment seen in FIG. 7, rather than dispersing the force among the pliers style handles shown in FIGS. 1-6. However, in order to tighten the jaws against a nut or bolt, a motion reversing gear set is used including a rack and pinion gear 90 (having a rack 92 and pinion 94) and an actuator gear 96. By squeezing the movable handle 70 towards the fixed handle 60, the pinion 94 is rotated counterclockwise, carrying the rack 92 and the movable jaw towards the fixed jaw. By allowing a user to concentrate the rotational force required to tighten or loosen a bolt or nut on the fixed handle 60, the longevity of the rack and pinion gear 90 may be prolonged.

While the invention has been described with reference to preferred and example embodiments, it will be understood by those skilled in the art that a variety of modifications, additions and deletions are within the scope of the invention, as defined by the following claims.

What is claimed is:

1. A self-adjustable wrench comprising:

an adjustable head having a first fixed jaw and a second movable jaw, the movable jaw being mounted for sliding movement in relation to the fixed jaw, the fixed and movable jaws having substantially parallel jaw faces and tapered ramps at the distal ends thereof to allow the jaws to receive a nut, the tapered ramps being at least as long as the jaw faces;

a pliers-style handle mechanism with first and second handles and coupled to the fixed jaw and the movable jaw, the handle mechanism being operated to draw the jaws tightly together when the first and second handles are squeezed together; and a biasing spring for urging the jaws towards a closed position, the spring having a first end and second end, the first end being coupled to the fixed jaw, and the second end being coupled to the movable jaw.

2. The adjustable wrench of claim 1, wherein the second handle is coupled to the second jaw with a gear mechanism.

3. The adjustable wrench of claim 2, wherein the gear mechanism comprises rack and pinion gears.

4. The adjustable wrench of claim 1, wherein the biasing spring for urging the jaws toward a closed position is a pulling spring.

5. The adjustable wrench of claim 1, wherein the handles are pivotally mounted to each other about a pivot axle which is movably mounted to the head so as to allow for adjustment of leverage exerted by the handles.

6. The adjustable wrench of claim 1, wherein the first handle and the first jaw lie along one longitudinal side of the wrench, while the second handle and the second jaw lie along an opposite longitudinal side of the wrench.

7. The adjustable wrench of claim 1, wherein the first handle and second jaw lie along one longitudinal side of the wrench, while the second handle and the first jaw lie along an opposite longitudinal side of the wrench.

8. The adjustable wrench of claim 1, wherein the wrench has an adjustable wrench-style head and pliers-style handles.

9. The adjustable wrench of claim 1, wherein the jaws are cutter style jaws.

10. A hand tool comprising:

a head having parallel jaws, with a fixed first jaw and a movable second jaw, the second jaw mounted for parallel, sliding movement relative to the first jaw;

a first handle rigidly coupled to the first jaw;

a second handle pivotally mounted to the first handle and coupled to the second jaw such that movement of the handles relative to each other causes the parallel jaws to open and close; and a biasing member for urging the jaws towards a closed position, the member having a first end and second end, the first end being coupled to the fixed jaw, and the second end being coupled to the movable jaw.

11. The hand tool of claim 10, wherein the second handle is coupled to the second jaw with a gear mechanism.

12. The hand tool of claim 11, wherein the gear mechanism comprises rack and pinion gears.

13. The hand tool of claim 10, wherein the biasing member comprises a spring.

14. The hand tool of claim 13, wherein the spring is a pulling spring.

15. The hand tool of claim 10, wherein the jaws have tapered distal ends to allow the jaws to be eased over an object.

16. The hand tool of claim 10, wherein the handles are pivotally mounted to each other about a pivot axle which is movably mounted to the head so as to allow for adjustment of leverage exerted by the handles.

17. The hand tool of claim 10, wherein the first handle and first jaw lie along one longitudinal side of the tool, while the second handle and the second jaw lie along an opposite longitudinal side of the tool.

18. The hand tool of claim 10, wherein the first handle and second jaw lie along one longitudinal side of the tool, while the second handle and the first jaw lie along an opposite longitudinal side of the tool.

19. The hand tool of claim 10, wherein the tool has an adjustable wrench-style head and pliers-style handles.

20. The hand tool of claim 10, wherein the parallel jaws are cutter style jaws.

21. The hand tool of claim 10, wherein the parallel jaws are 120-degree recess style jaws.

* * * * *